US008397692B2

(12) United States Patent
Carbonne et al.

(10) Patent No.: US 8,397,692 B2
(45) Date of Patent: Mar. 19, 2013

(54) METHOD FOR SYNCHRONIZING INJECTION WITH THE ENGINE PHASE IN AN ELECTRIC INJECTOR CONTROLLED ENGINE

(75) Inventors: Laure Carbonne, Toulouse (FR); Alain Gonzalez, Toulouse (FR); Roger Rouphael, L'Union (FR); Robertus Vingerhoeds, Toulouse (FR)

(73) Assignee: Continental Automotive France, Toulouse (FR)

( * ) Notice: Subject to any disclaimer, the term of this patent is extended or adjusted under 35 U.S.C. 154(b) by 1675 days.

(21) Appl. No.: 10/549,570

(22) PCT Filed: Apr. 1, 2004

(86) PCT No.: PCT/EP2004/003443
§ 371 (c)(1),
(2), (4) Date: May 24, 2006

(87) PCT Pub. No.: WO2004/092564
PCT Pub. Date: Oct. 28, 2004

(65) Prior Publication Data

US 2007/0023004 A1 Feb. 1, 2007

(30) Foreign Application Priority Data

Apr. 17, 2003 (FR) ..... 03 04836

(51) Int. Cl.
*F02D 41/30* (2006.01)

(52) U.S. Cl. ..... 123/305; 123/299; 123/294

(58) Field of Classification Search ..... 290/34; 251/149.7; 123/295
See application file for complete search history.

(56) References Cited

U.S. PATENT DOCUMENTS

| | | | | |
|---|---|---|---|---|
| 3,719,176 | A * | 3/1973 | Shinoda et al. | 123/492 |
| 5,613,473 | A | 3/1997 | Angermaier | |
| 5,970,784 | A | 10/1999 | Genin | |
| 6,138,638 | A * | 10/2000 | Morikawa | 123/295 |

FOREIGN PATENT DOCUMENTS

| | | |
|---|---|---|
| DE | 198 44 910 | 4/2000 |
| EP | 0 640 762 | 3/1995 |
| EP | 0 846 852 | 6/1998 |
| EP | 0 987 421 | 3/2000 |

* cited by examiner

*Primary Examiner* — Lindsay Low
(74) *Attorney, Agent, or Firm* — Young & Thompson

(57) ABSTRACT

In a method relating to an engine with n cylinders, fuel is injected in a predetermined order into the cylinders in a manner which is synchronized with the position of the pistons of the engine. The method includes the following steps after start-up: injection into m cylinders in a predetermined order of injection; measurement of engine speed and/or acceleration; continuation of injection in a predetermined order of injection if engine speed and/or acceleration exceed(s) a predetermined threshold; continuation of injection with a delay in the event of the contrary. The method can be used with respect to the start-up of a direct injection engine.

19 Claims, 2 Drawing Sheets

Figure 1:
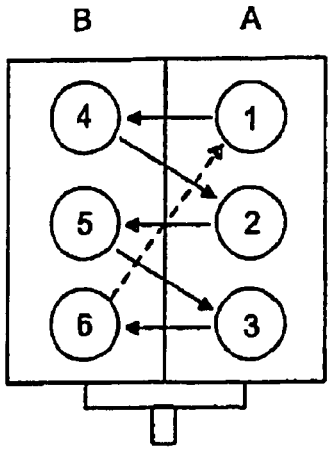

METHOD FOR SYNCHRONIZING INJECTION WITH THE ENGINE PHASE IN AN ELECTRIC INJECTOR CONTROLLED ENGINE

BACKGROUND OF THE INVENTION

1. Field of the Invention

The present invention relates to a method of synchronizing the injection with the engine phase in an engine with electronic injector control.

2. Description of the Related Art

With the development of new generations of engines, particularly direct injection engines, electronic control of fuel injection into the cylinders has become widespread. It permits total control of the instant at which the fuel is injected into the cylinder. Thus, it enables the fuel to be injected with an accuracy of 3°, in other words within a very precise injection interval.

In a four-stroke engine, it is important to know not only the position of the pistons in the cylinders, and consequently the position of the crankshaft, but also the phase of the engine. Thus, when the piston in a cylinder is at top dead center, it is important to know whether it is at the end of the compression stroke or at the end of the exhaust stroke. Two position sensors are used for this purpose. A first sensor on the crankshaft indicates the relative position of the pistons in the cylinders and a second sensor on the camshaft indicates the engine phase (induction, compression, expansion or exhaust).

Generally, the information supplied by the sensor located on the camshaft is used only when the engine is started, to determine the cylinders into which the first injections are to be made. The injection sequence is then implemented according to a predetermined cycle and only synchronization with the crankshaft is required.

BRIEF SUMMARY OF THE INVENTION

The object of the present invention is therefore to provide a synchronization method which, on starting, makes it unnecessary to rely on the information received from the sensor located on the camshaft. Thus, even if this sensor is defective, the engine can still be started. It is also possible to eliminate this sensor, which is not used for any other purpose.

For this purpose, the invention proposes a method of synchronizing the injection with the engine phase in an engine with electronic injector control having n cylinders into which fuel is injected successively in a predetermined sequence, the fuel injection being synchronized with the position of the piston in the corresponding cylinder.

According to the present invention, this method comprises the following steps, performed when the engine is started:

- injection of fuel into m cylinders in the predetermined injection sequence when the corresponding pistons, put into motion by means of a starter, are at the end of the compression phase, m being determined in advance as a function of n,
- measurement of the engine speed and/or its acceleration,
- continuation of the injection in the predetermined sequence if the engine speed and/or its acceleration exceed a predetermined threshold, the injection being synchronized with the engine phase in this case,
- continuation of the injection with a phase change with respect to the preceding injections and with respect to the predetermined sequence, this phase change being a function of n and m, so that the injection is synchronized with the engine phase, in the contrary case.

In this method, it is accepted that, for the first m injections carried out, the injection is not synchronized with the compression phases of the engine. This lack of synchronization is then detected and corrected.

Preferably, the engine speed and/or its acceleration are measured after approximately one revolution of the engine. This makes it possible to limit the time for which the injection is not synchronized in cases in which the first injections are not carried out in a compression phase.

If the engine to which the method according to the invention is applied has an even number of cylinders, fuel is injected into half of the cylinders before the engine speed or its acceleration is measured; in other words m=n/2.

To confirm that the choice made after the first measurement is correct, a second measurement of the engine speed and/or its acceleration is made after p further injections, p being determined in advance as a function of n and m, to check that the synchronization is correct. In this case, it is advantageous for the second measurement of the engine speed and/or its acceleration to be made after two revolutions of the engine, in other words after n injections of fuel.

In the method according to the invention, the position of the pistons in the cylinders of the engine is determined by a position sensor measuring the angular position of the corresponding engine flywheel.

To prevent any excessive emission of unburnt fuel to the atmosphere, the invention proposes a variant embodiment in which the dose of fuel injected in the first m injections is smaller than that used in the subsequent injections.

BRIEF DESCRIPTION OF THE DRAWING FIGURES

Figure 2:
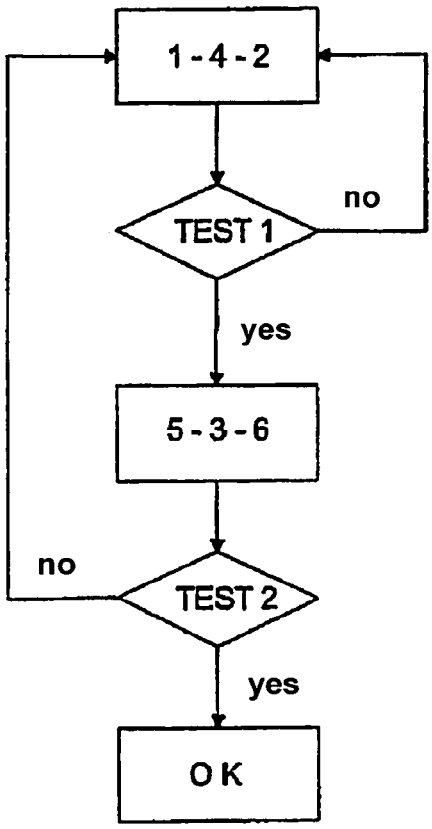
Figure 3:
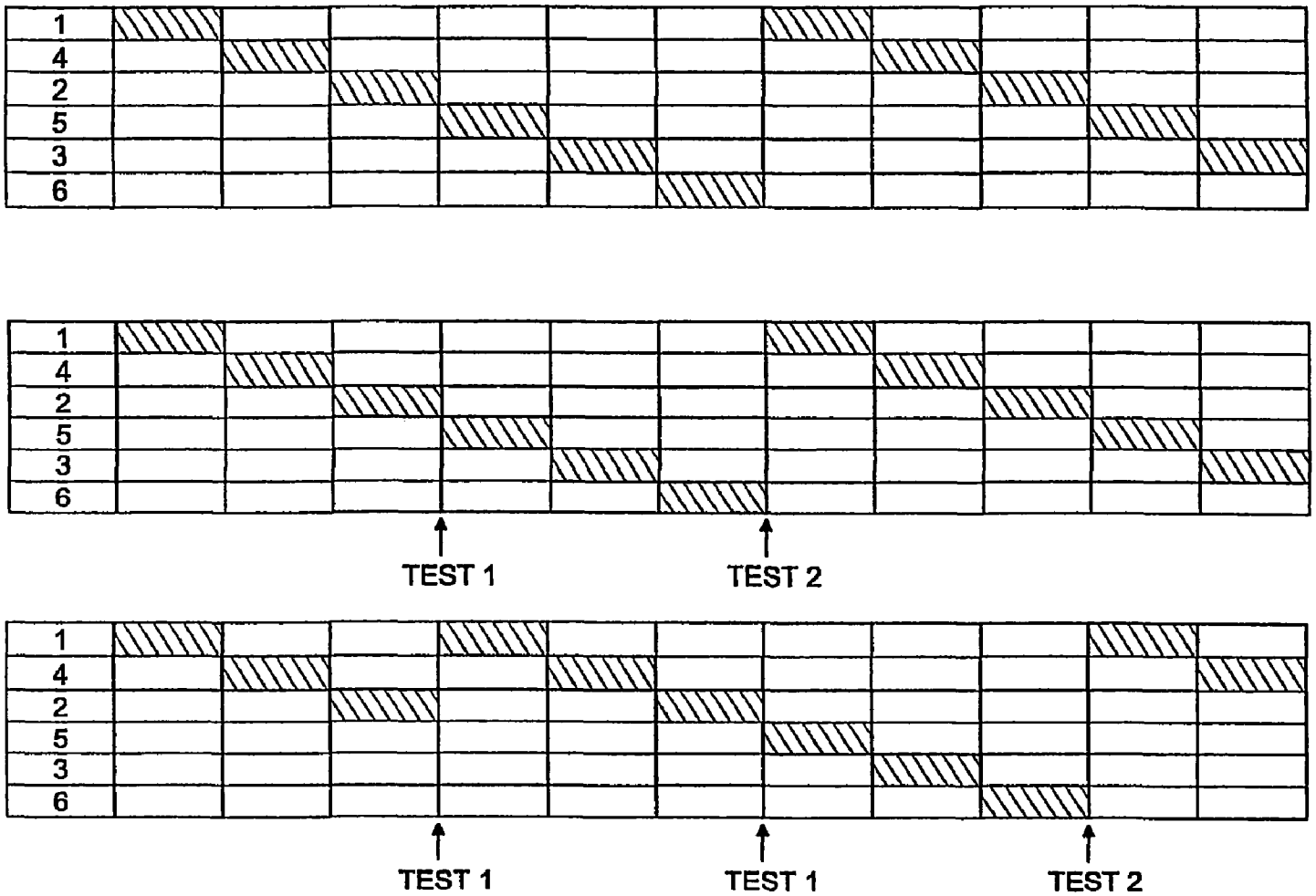

Details and advantages of the present invention will be made clearer by the following description, provided with reference to the attached schematic drawing, in which:

FIG. 1 shows the sequence of injection of fuel into the cylinders of a V6 engine, FIG. 2 is a flow diagram for a method according to the invention for a V6 engine, and FIG. 3 shows the sequence of fuel injections in three examples.

DETAILED DESCRIPTION OF THE PREFERRED EMBODIMENTS

The present invention is described below in a preferred embodiment applied to an engine having six cylinders in a V formation. These cylinders are distributed in two lines, identified as A and B (see FIG. 1). The cylinders themselves are numbered from 1 to 6, cylinders 1 to 3 forming the line of cylinders identified as A and cylinders 4 to 6 forming the line of cylinders identified as B.

In this case the engine is a four-stroke diesel engine, although the present invention is applicable to a four-stroke gasoline engine. An injector is provided to inject fuel into each of the cylinders. These six injectors are electronically controlled. Two sensors are generally provided to determine the instant at which the fuel has to be injected into the cylinder. In the first place, there is a sensor, referred to below as the crank sensor, which indicates for each cylinder the exact position of the piston sliding therein. The fuel must be injected when the piston is approximately at the top dead center, but at a slight distance from this top dead center. The crank sensor enables the angular position of the engine crankshaft to be found by measuring the rotation of the engine flywheel associated with this crankshaft. The crank sensor thus enables the position of a piston in a cylinder to be known, but does not enable the current phase of the combustion cycle to be identified. Thus the crank sensor can determine the top dead center for the six cylinders of the engine. However, when a piston is at its top dead center, there is no way of knowing whether it is at the end of the compression phase or the exhaust phase. This information can be obtained from the sensor referred to below as the cam sensor. This cam sensor is linked to the camshaft of the engine, or to one of the camshafts when there is more than one. Clearly, it is possible to provide one cam sensor for each camshaft. The angular position of a camshaft can be used, in a known way, to identify the phase of the four-stroke cycle for each cylinder.

The information provided by the cam sensor is used when the engine is started. When the engine is started by a starter, fuel is injected into the first cylinder which reaches the end of the compression stroke. The position of the corresponding piston is given by the crank sensor and the cam sensor, and indicates that the corresponding valves are closed and that this piston has just compressed some air.

The present invention proposes a method of starting the engine without the information provided by the cam sensor. This makes it possible to overcome a failure of this sensor or even to design an engine without this sensor, which would enable the cost of the engine to be decreased accordingly.

In the V6 engine described above, the fuel is injected into the cylinders in a predetermined sequence to achieve correct operation of the engine. This sequence is shown in FIG. 1. If an injection of fuel is made into the cylinder numbered 1, the next injection will be made into the cylinder numbered 4, then 2, then 5, then 3, then 6, then 1 again, and so on.

FIG. 2 is a flow diagram showing the method according to the invention applied to the engine described above. It is assumed that the starter has just been activated. The crank sensor is then used to find the cylinder in which a piston has reached its top dead center. It is assumed that this is cylinder 1 in this case. Fuel is then injected into this cylinder 1 (with the piston at the normally specified distance from the top dead center). At this point it is not known whether the engine phase in this cylinder 1 is the end of a compression stroke or an exhaust stroke. Fuel is then injected into cylinders 4 and 2, in this sequence, when the crank sensor indicates that the corresponding pistons are correctly positioned.

When these three injections have been made into cylinders 1, 4 and 2, a check is made to determine whether the injected fuel has been burnt (step TEST 1 of FIG. 2). If this is the case, the combustion will have supplied mechanical energy and the engine speed will increase. Otherwise, nothing will have happened, and the engine speed will still be equal to the speed produced by the starter.

Consequently the combustion test is conducted by measuring the engine speed. It is assumed here that, if the engine speed is greater than 300 r.p.m., the fuel has been burnt and combustion has taken place in cylinders 1, 4 and 2. In this case, the injection cycle can be continued and the next injections are made into cylinders 5, 3 and 6.

If the combustion test TEST 1 is negative, in other words if the engine speed remains below 300 r.p.m., it is assumed that the fuel has been injected at the end of the exhaust phase. The phase of the injection must therefore be shifted through 360°. In the present case, this means that fuel must be reinjected into cylinder 1, instead of being injected into cylinder 5. A series of injections into cylinders 1, 4 and 2 is therefore repeated. At the end of these injections, the combustion test TEST 1 is repeated in order to determine whether combustion has actually taken place and has supplied mechanical energy. If this is the case, the injection cycle can be continued and the next injections are made into cylinders 5, 3 and 6.

A second combustion test (shown as TEST 2 in FIG. 2) is conducted after these three further injections. If the first combustion test TEST 1 was positive, this second combustion test TEST 2 should confirm it. For this to happen, the engine speed must be greater than 300 r.p.m.

FIG. 3 summarizes the first injections in the engine of FIG. 1 in three separate cases. In the first case, it is assumed that the engine is fitted with a crank sensor and a cam sensor, both sensors being in an operational state. In the second and third cases, the cam sensor is defective or possibly absent. In the second case, after the first three injections (cylinders 1, 4 and 2), the combustion test TEST 1 is positive. The injection cycle continues. After the injections into cylinders 5, 3 and 6, the combustion test TEST 2 is positive and the injection cycle (1-4-2-5-3-6-1 . . . ) continues.

In the third case, the first combustion test TEST 1 is negative. Injection is then repeated into cylinders 1, 4 and 2. A further combustion test TEST 1 is then conducted and is positive. The injection is then continued into cylinders 5, 3 and 6, and the combustion test TEST 2 is positive. The injection cycle (5-3-6-1-4-2-5 . . . ) continues.

The first combustion test TEST 1 is conducted after one revolution of the engine. It has been mentioned that this 360° rotation is sufficient to establish and demonstrate the starting of the engine. The second combustion test TEST 2 is conducted if the first combustion test is positive, in other words two revolutions after the actual starting has been initiated. A complete cycle has thus taken place in each cylinder.

To avoid the emission of excessive unburnt fuel, the quantity of fuel injected in the first three injections can be limited. These quantities must be sufficient to enable the engine to be started if the synchronization is correct from the time of the first injection.

The method according to the invention is applied when the signal from the cam sensor is not available, either because this sensor is absent or because it is defective. On the other hand, the injection must be synchronized with the rotation of the crankshaft. Preferably, the vehicle is stationary. Before this method is applied, the engine control system checks that no error in the injection system has been signaled, to ensure that this starting procedure is not impeded.

The present invention therefore makes it possible to avoid the use of a cam sensor for starting a diesel engine or any other engine whose injection is electronically controlled.

Tests conducted on engines have demonstrated the efficacy of this method. When the rotation speed produced by the starter is in the range from 210 to 230 r.p.m., the engine speed measured after three combustions in a six-cylinder engine is approximately 320 r.p.m. The speed of 300 r.p.m., for example, can also be used as a threshold for the combustion tests. This measurement does not require the use of a special sensor, since provision is made for measuring the engine speed in each engine for the engine control system.

As a variant, it is possible to measure variations in the engine speed, rather than measuring the value of the engine speed. If a significant acceleration in the engine speed is detected, it can then be assumed that combustion has taken place and that the injection is therefore synchronized with the engine phases.

The present invention is not limited to the method and its variants described above in the form of non-restrictive examples. It also relates to all other variant embodiments which may be produced by those skilled in the art within the context of the following claims.

The invention claimed is:

1. A method of synchronizing injection with engine phase in an engine with electronic injector control having n cylinders into which fuel is injected directly into each of the cylinders successively in a predetermined sequence, the fuel injection being synchronized with a position of a piston in the corresponding cylinder, the method comprising the following steps, performed when the engine is started:

injecting fuel into m cylinders in the predetermined injection sequence when the corresponding pistons, put into motion by means of a starter, are at an end of a compression phase, m being determined in advance as a function of n, measuring engine speed and/or acceleration, continuing the injection in the predetermined sequence if the engine speed and/or acceleration exceed a predetermined threshold, the injection being synchronized with the engine phase in this case, and continuing the injection with a phase change with respect to the preceding injections and with respect to the predetermined sequence, this phase change being a function of n and m, so that the injection is synchronized with the engine phase, in the contrary case, wherein the method does not employ a camshaft sensor.

2. The synchronization method as claimed in claim 1, characterized in that the engine speed and/or acceleration are measured after approximately one revolution of the engine.

3. The synchronization method as claimed in claim 1, for an engine having an even number of cylinders, wherein m =n/2.

4. The synchronization method as claimed in claim 1, wherein a second measurement of the engine speed and/or its acceleration is made after p further injections, p being determined in advance as a function of n and m, to check that the synchronization is correct.

5. The synchronization method as claimed in claim 4, wherein the second measurement of the engine speed and/or its acceleration is made after two actual revolutions of the engine, in other words after n injections of fuel.

6. The synchronization method as claimed in claim 1, wherein the position of the pistons in the cylinders of the engine is determined by a position sensor measuring an angular position of a corresponding engine flywheel.

7. The synchronization method as claimed in claim 1, wherein a dose of fuel injected a first m injections being smaller than that used in subsequent injections.

8. The synchronization method as claimed in claim 2, for an engine having an even number of cylinders, wherein m =n/2.

9. The synchronization method as claimed in claim 2, wherein a second measurement of the engine speed and/or its acceleration is made after p further injections, p being determined in advance as a function of n and m, to check that the synchronization is correct.

10. The synchronization method as claimed in claim 3, wherein a second measurement of the engine speed and/or its acceleration is made after p further injections, p being determined in advance as a function of n and m, to check that the synchronization is correct.

11. The synchronization method as claimed in claim 2, wherein the position of the pistons in the cylinders of the engine is determined by a position sensor measuring an angular position of a corresponding engine flywheel.

12. The synchronization method as claimed in claim 3, wherein the position of the pistons in the cylinders of the engine is determined by a position sensor measuring an angular position of a corresponding engine flywheel.

13. The synchronization method as claimed in claim 4, wherein the position of the pistons in the cylinders of the engine is determined by a position sensor measuring an angular position of a corresponding engine flywheel.

14. The synchronization method as claimed in claim 5, wherein the position of the pistons in the cylinders of the engine is determined by a position sensor measuring an angular position of a corresponding engine flywheel.

15. The synchronization method as claimed in claim 2, wherein a dose of fuel injected in the first m injections is smaller than that used in subsequent injections.

16. The synchronization method as claimed in claim 3, wherein a dose of fuel injected in the first m injections is smaller than that used in subsequent injections.

17. The synchronization method as claimed in claim 4, wherein a dose of fuel injected in the first m injections is smaller than that used in subsequent injections.

18. The synchronization method as claimed in claim 5, wherein a dose of fuel injected in the first m injections is smaller than that used in subsequent injections.

19. The synchronization method as claimed in claim 6, wherein a dose of fuel injected in the first m injections is smaller than that used in subsequent injections.

* * * * *

UNITED STATES PATENT AND TRADEMARK OFFICE

CERTIFICATE OF CORRECTION

PATENT NO. : 8,397,692 B2
APPLICATION NO. : 10/549570
DATED : March 19, 2013
INVENTOR(S) : Carbonne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1897 days.

Signed and Sealed this
First Day of September, 2015

Michelle K. Lee

Michelle K. Lee
*Director of the United States Patent and Trademark Office*